United States Patent [19]

Ziemba

[11] Patent Number: 4,991,508

[45] Date of Patent: Feb. 12, 1991

[54] ELECTRIC FIELD ENABLED PROXIMITY FUZING SYSTEM

[75] Inventor: Richard T. Ziemba, Burlington, Vt.

[73] Assignee: General Electric Company, Burlington, Vt.

[21] Appl. No.: 451,901

[22] Filed: Dec. 18, 1989

[51] Int. Cl.[5] ..... F42C 13/00

[52] U.S. Cl. ..... 102/211; 102/213; 102/214; 102/215

[58] Field of Search ..... 102/211, 212, 213, 214, 102/215

[56] References Cited

U.S. PATENT DOCUMENTS

| | | | |
|---|---|---|---|
| 2,454,630 | 11/1948 | Buckthal | 177/311 |
| 3,326,130 | 6/1967 | Baker | 102/214 |
| 3,802,343 | 4/1974 | Dahl | 102/214 |
| 3,871,296 | 3/1975 | Heilprin et al. | 102/70.2 P |
| 3,877,377 | 4/1975 | Rabinow | 102/214 |
| 3,902,172 | 8/1975 | Weiss et al. | 343/6 ND |
| 3,905,298 | 9/1975 | Rembock | 102/214 |
| 4,005,357 | 1/1977 | Parkinson | 324/32 |
| 4,015,530 | 4/1977 | Dick | 102/213 |
| 4,056,061 | 11/1977 | Becklund | 102/213 |
| 4,183,303 | 1/1980 | Krupen | 102/211 |
| 4,185,560 | 1/1980 | Levine | 102/214 |
| 4,193,072 | 3/1980 | McKusick | 343/6 ND |
| 4,195,294 | 3/1980 | Reid | 102/214 |
| 4,291,627 | 9/1981 | Ziemba et al. | 102/265 |
| 4,667,598 | 5/1987 | Grobler et al. | 102/215 |

*Primary Examiner*—Charles T. Jordan
*Assistant Examiner*—Rochelle Lieberman
*Attorney, Agent, or Firm*—Bailin L. Kuch; Robert A. Cahill

[57] ABSTRACT

A proximity fuzing system includes a passive proximity detection section including an electrostatic probe for detecting initial missile entry into the electric field inherently associated with an airborne target. Probe signals are processed to determine that the intercepted electric field is characteristic of a valid target, and, if so, an active proximity detection section, such as a radar proximity detector, is rendered operational to trigger a warhead detonator at the optimum point in the missile's engaging trajectory to inflict maximum possible damage on the target.

6 Claims, 3 Drawing Sheets

ELECTRIC FIELD ENABLED PROXIMITY FUZING SYSTEM

The present invention relates generally to proximity fuzing systems and particularly to proximity fuzing systems for the warheads of missiles engaging an airborne target.

BACKGROUND OF THE INVENTION

Current missile fuzing systems typically utilize RF (radar) optical (infrared) sensors to detect missile proximity to an airborne target and to detonate the missile warhead at the opportune point in the missile trajectory to maximize the damage inflicted on the target. Unfortunately such proximity fuzing systems are susceptible to being prematurely triggered by natural effects, such as rain, snow, clouds and sun, and, in the case of low level targets such as helicopters, by clutter produced by water waves, terrain promontories, and salvo effects. In addition, these proximity fuzing systems can be "spoofed" by countermeasures effected by the target. RF sensors can be jammed electronically, and optically sensors can be confused by flares. The results are either no warhead detonation or detonation outside the target kill range.

To minimize proximity fuzing system malfunction due to these various effects, it is known to utilize an onboard timer which is preset prior to missile launch to delay or "both" system activation and/or enablement until the missile is in close engagement with an airborne target. This approach, however, requires some form of data link with the missile, typically a hard wire, to permit presetting the timer just prior to launch. This data link complicates the fuzing system electronics, increases cost, and reduces reliability.

As another approach to minimizing the sensitivity of proximity fuzing systems to natural effects and target countermeasures, it has been proposed to use electrostatic sensors to detect target proximity. See, for example, Ziemba et al., U.S. Pat. No. 4,291,627, issued Sept. 29, 1981. As is well known, the outer surface of any airborne target becomes electrostatically charged while in flight through the atmosphere due to the effects of air friction and engine ionization. Thus, detection of the electric field closely surrounding an airborne target can provide a means for detecting the proximity of an attacking missile to an airborne target. See, for example, Krupen U.S. Pat. No. 4,183,303, issued Jan. 15, 1980. Since this inherent electric field can not be readily recreated in disassociated relation to the target, electrostatic fuzing system sensors are not susceptible to being foiled by target countermeasures. Moreover, electrostatic sensors are not influenced by ground clutter, as, for example, during terrain-hugging trajectories to engage low-flying targets, such as helicopters.

SUMMARY OF THE INVENTION

It is accordingly an object of the present invention to provide an improved proximity fuzing system for missiles engaging airborne targets.

A further object is to provide a missile fuzing system of the above-character, which is essentially immune to false target effects and target countermeasures.

An additional object is to provide a missile fuzing system of the above-character, wherein warhead detonation is inhibited until an attacking missile is in close encounter with an intended airborne target.

Another object is to provide a missile fuzing system of the above-character, which is more reliable in its purpose to destroy an airborne target.

Other objects of the invention will in part be obvious and in part appear hereinafter.

Pursuant to the foregoing objectives, the present invention provides a combination active and passive proximity fuzing system for functioning the warhead of a missile while engaging an airborne target. The proximity fuzing system thus includes a passive proximity sensing section including an electrostatic sensing probe for detecting initial missile entry into the electric field inherently associated with an airborne target. The probe signals are processed to the extent necessary to determine that the detected electrical field is characteristic of the intended target. Upon determination that a valid target is being engaged, an arming signal is generated to render operational an active proximity detection section including a RF (radar) transceiver. The RF signals returned by the target are then processed to determine the optimum point in the missile's engaging trajectory to detonate the warhead and thus inflict the maximum possible damage on the target.

The invention accordingly comprises the features of construction, combinations of elements, and arrangements of parts, all of which as detailed below, and the scope of the invention will be indicated in the claims.

BRIEF DESCRIPTION OF THE DRAWINGS

For a full understanding of the nature and objects of the present invention, reference may be had to the following Detailed Description taken in conjunction with the accompanying drawings, in which.

Like reference numerals refer to corresponding parts throughout the several figures of the drawings.

DETAILED DESCRIPTION

Figure 1:
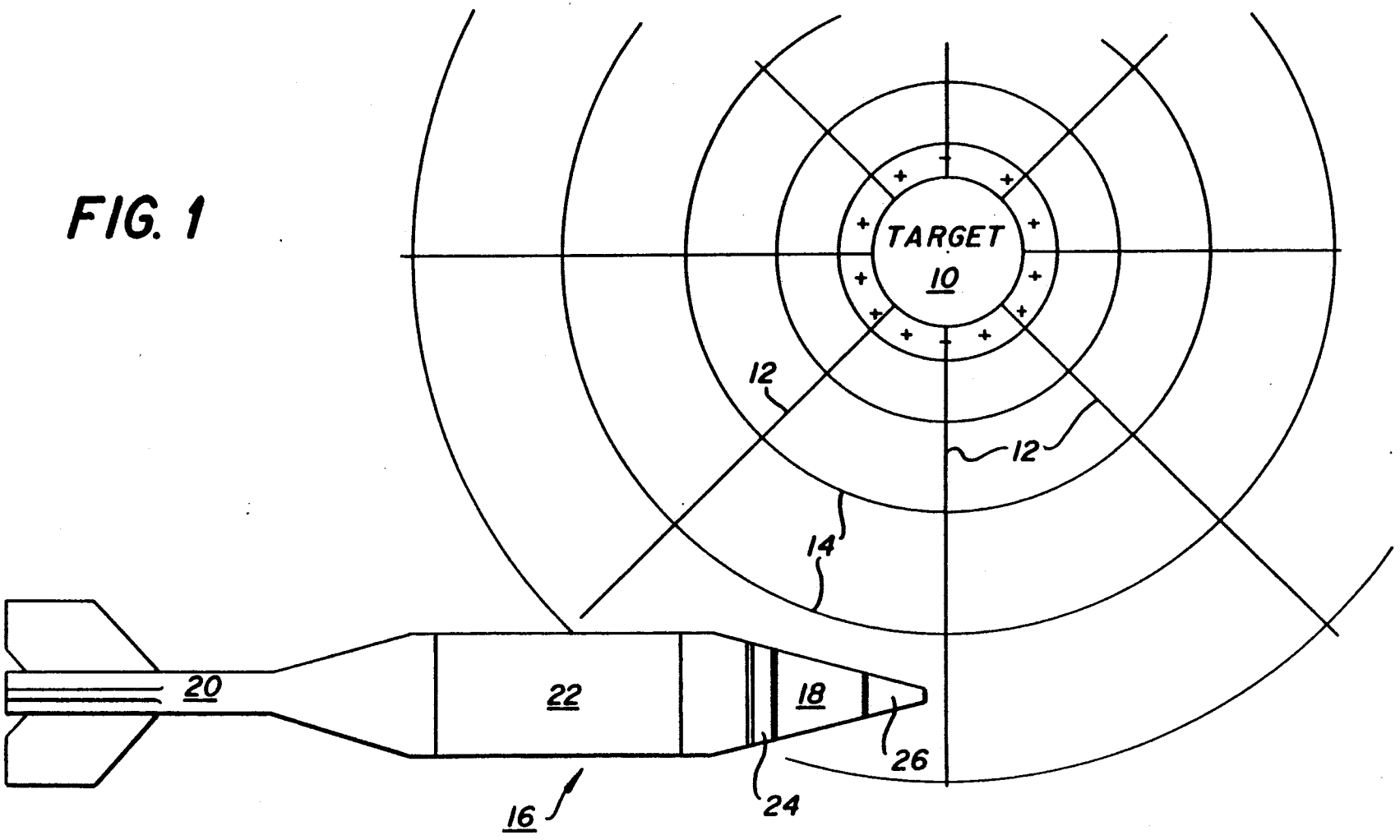
FIG. 1 is a pictorial illustration of a missile entering the electric field associated with an intended airborne target and equipped with a proximity fuzing system constructed in accordance with the present invention.

FIG. 1 portrays an airborne target 10, such as an airplane or helicopter, which in flight through the atmosphere has accumulated the indicated surface charges. These electrostatic charges create an electric field pattern represented by flux lines 12 radiating from the target and lines 14 of equal electrostatic potential encircling the target at various radial increments. It will be appreciated that the illustrated target electric field pattern is idealized since it does not reflect the disruption created by the surface charges accumulated on the surface of a missile 16 illustrated as having entered the target electric field on a target-engaging trajectory.

The body of missile 16 includes a nose section 18, a finned tail section 20 and an intermediate warhead section 22. The nose section contains the electrical components of the proximity fuzing system of the present invention including, as seen in FIG. 1, an electrostatic sensing probe 24 in the form of an exposed conductive ring conforming to the conical nose section surface and a RF antenna 26. Both the probe and the antenna are insulated from the metallic body of the missile.

Figure 2:
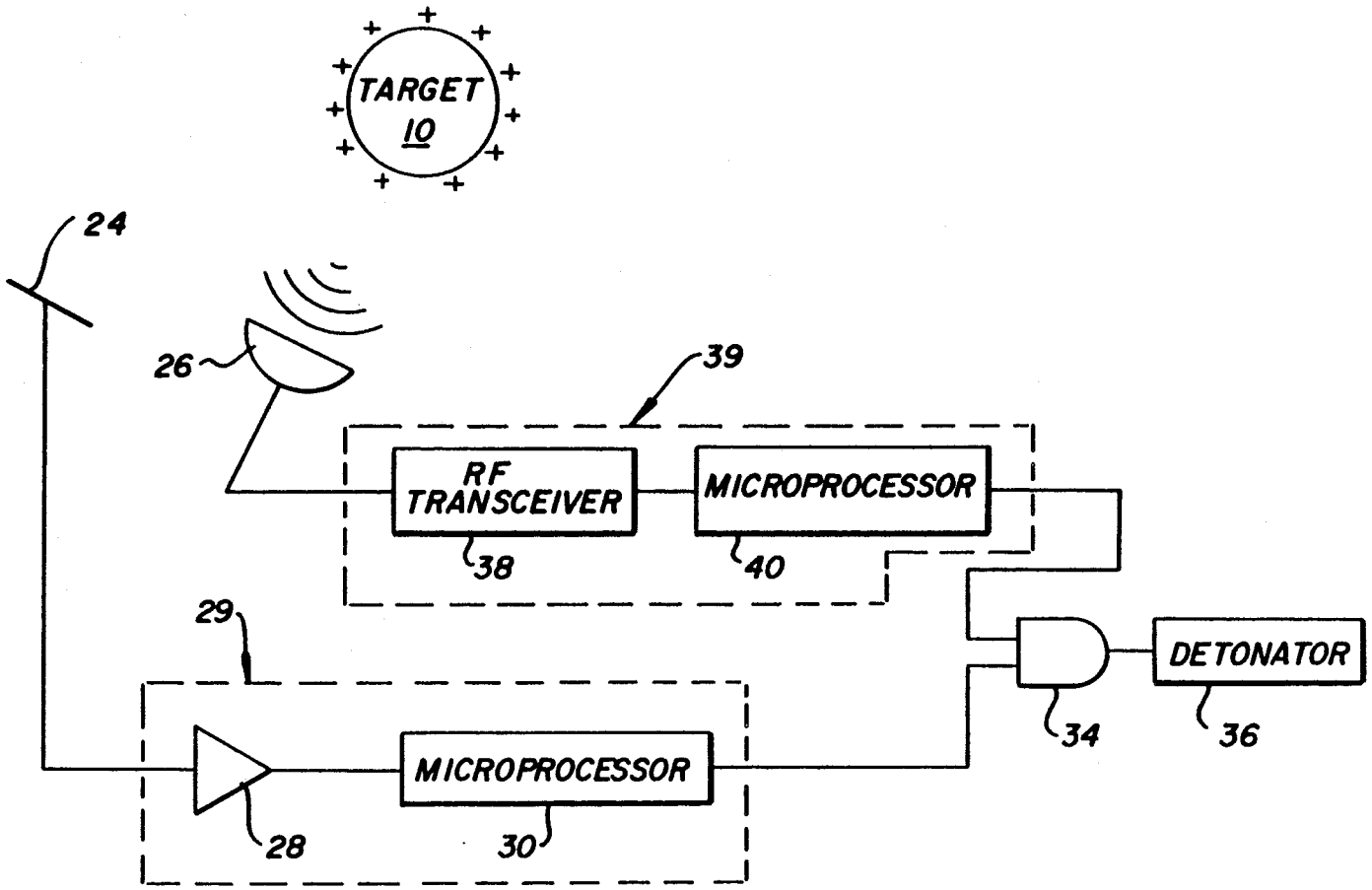
FIG. 2 is a schematic block diagram of a proximity fuzing system constructed in accordance with one embodiment of the invention.

Turning to FIG. 2, electrostatic probe 24 is electrically connected to the input of a high grain, high input impedance operational amplifier circuit 28 included in a passive proximity detection section, generally indicated at 29. As the missile enters the electric field of the target, a voltage is developed on probe 24. Current proportional to this probe voltage is converted to a signal voltage and amplified in several amplifier stages. The amplifier signal output is fed to a microprocessor 30 where it is digitized and examined for waveform, shape and polarity. These signal characteristics are processed by target algorithms stored in memory to determine if they reasonably represent the electric field characteristics of a valid airborne target. If so, microprocessor 30 issues an arming signal to enable a coincidence gate 34. The output of this gate is connected to a detonator 36 for the missile warhead.

Meanwhile, an RF transceiver 38 of an active proximity detection section, generally indicated at 39, is transmitting signals via radar antenna 26 and receiving return signals from target 10, as well as from false targets existing due to natural effects and/or target countermeasures. These return signals are processed in conventional fashion by a microprocessor 40 to generate a detonator triggering signal for application to the other input of coincidence gate 34. However, until the missile is within the target detection range of passive detection section 29, gate 34 is inhibited. Therefore, the active detection section is not yet operational, since spurious triggering signals issued by microprocessor 40 are blocked by the gate to preclude premature firing of detonator 36. Once the gate is enabled by an arming signal, the missile is sufficiently close to target 10 that microprocessor 40 can readily distinguish between valid target return signals and any false target return signals. The microprocessor then effectively locks onto target 10 by processing only its return signals in a manner such that detonator 36 is triggered to explode the warhead at the point in the target-engaging trajectory when the missile is in optimum proximate relation with the target to inflict maximum damage thereon.

Figure 3:
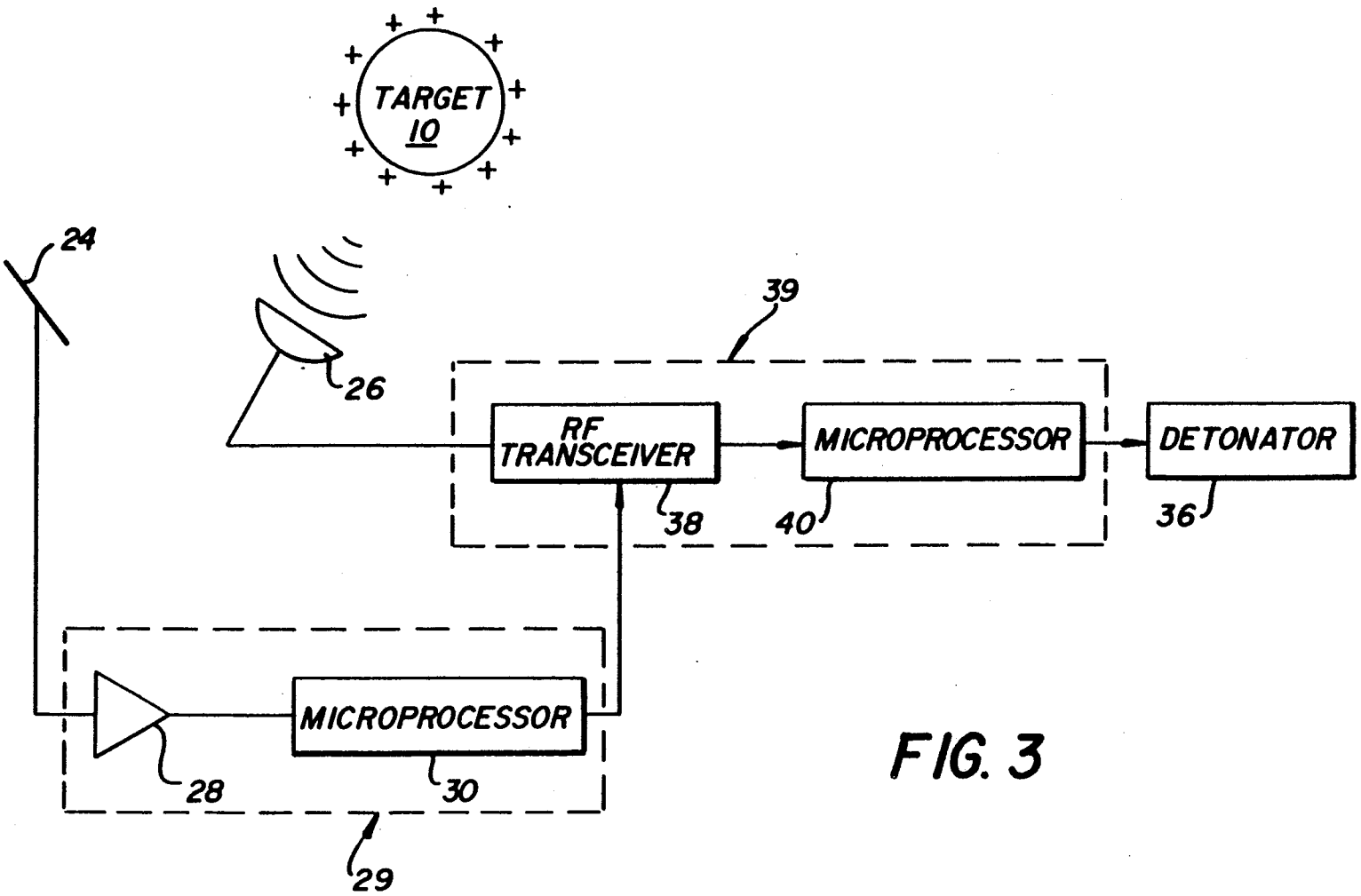
FIG. 3 is a schematic block diagram of a proximity fuzing system constructed in accordance with an alternative embodiment of the invention.

FIG. 3 illustrates an alternative embodiment of the invention, wherein active detection section 39 is maintained inactive or inoperative until passive detection section 29 has identified a valid target within its detection range. Thus, instead of using the arming signal to enable a gate to pass a subsequent detonator triggering signal pursuant to the embodiment of FIG. 2, the arming signal is utilized to activate or turn on transceiver 38. Only then are radar signals transmitted and received. The return signals from target 10 are processed to generate a timely triggering signal directly to detonator 36.

The advantage of the embodiment of FIG. 3 lies in the fact that, by not activating active detection section 39 until the target is within the detection range of passive detection section 29, there are no early RF transmissions which the target can detect and, in response, deploy countermeasures. When transceiver is turned on to render the active detection section operational, there is insufficient time for the target to react with effective countermeasures.

While the present invention has been disclosed as utilizing an RF proximity detection section, once operational, to generate the eventual detonator triggering signal, it will be appreciated that a detection section utilizing an infrared (IR) proximity sensor could be substituted therefor. Sensor responses to IR signals from valid and false targets are simply ignored until the missile is within the detection range of a valid target as identified by the electrostatic detection section.

From the foregoing description it is seen that the present invention provides a proximity fuzing system which is armed or rendered fully operational only when the missile is proximate a valid target. This is achieved without the need of a data link between the missile and its launch control. Through the utilization of an electrostatic sensor to detect target proximity and only then to enable ultimate target proximity detection by conventional means, premature warhead detonation in response to false targets is avoided. It is appreciated that the fuzing system is inherently very reliable since both proximity detection sections 29 and 39 must identify a valid proximate target before the detonator can be triggered.

While the fuzing system of the present invention is operational to initiate warhead detonation only when engaging airborne targets, it will be appreciated that the system may be equipped with provisions to detonate the warhead upon impact, as taught in the above-cited U.S. Pat. No. 4,291,627. So equipped, the missile can be used against ground targets as well, with the proximity fuzing system of the present invention precluding premature detonation due to ground clutter.

In view of the foregoing, it is seen that the objects set forth above, including those made apparent from the Detail Description, are efficiently attained and, since certain changes may be made in the embodiments set forth without departing from the invention, it is intended that all matters of detail be taken as illustrative and not in a limiting sense.

Having described the invention, what is claimed as new and desired to secure by Letters Patent is:

1. A proximity fuzing system for a warhead of a missile engaging an airborne target, said system comprising, in combination:

A. a detonator;

B. a first detection section for generating a triggering signal to said detonator; and C. a second detection section including an electrostatic probe and signal processing means for processing, pursuant to stored target algorithms, signals indicative of voltages developed on said probe upon missile entry into an electric field associated with an airborne target for generating an arming signal indicating the presence of a valid target within the detection range of said probe, said arming signal being applied to render said first detection section operational to initiate warhead explosion by said detonator.

2. The fuzing system defined in claim 1, which further includes a coincidence gate having a first input connected to receive said triggering signal and second input connected to receive said arming signal, and an output connected to said detonator, whereby said triggering signal is passed to said detonator only while said gate is enabled by said arming signal.

3. The fuzing system defined in claim 1, wherein said first detection section includes a radar antenna, a transceiver connected with said antenna for transmitting and receiving RF signals and means for processing received RF signals to generate said triggering signal.

4. The fuzing system defined in claim 3, which further includes a coincidence gate having a first input connected to receive said triggering signal and a second input connected to receive said arming signal, and an output connected to said detonator, whereby said triggering signal is passed to said detonator only while said gate is enabled by said arming signal.

5. A proximity fuzing system for a warhead of a missile engaging an airborne target, said system comprising, in combination:

A. a detonator;

B. a first detection section for generating a triggering signal to said detonator, said first detector section being normally inactive and incapable of generating said triggering signal, and C. a second detection section including an electrostatic probe and signal processing means responsive to voltages developed on said probe upon missile entry into an electric field associated with an airborne target for generating an arming signal indicating the presence of a valid target within the detection range of said probe, said arming signal being applied to activate said first detection section and capable of generating said triggering signal to initiate warhead explosion by said detonator.

6. A proximity fuzing system for a warhead of a missile engaging an airborne target, said system comprising, in combination:

A. a detonator;

B. a first detection section including a radar antenna, a transceiver connected with said antenna for transmitting and receiving RF signals and means for processing said RF signals to generate a triggering signal to said detonator, said transceiver being normally inactive; and C. a second detection section including an electrostatic probe and signal processing means responsive to voltages developed on said probe upon missile entry into an electric field associated with an airborne target for generating an arming signal indicating the presence of a valid target within the detection range of said probe, said arming signal being applied to activate said transceiver and thus enable generation of said triggering signal to initiate warhead explosion by said detonator.

* * * * *